United States Patent [19]

Breslow et al.

[11] 4,244,573

[45] Jan. 13, 1981

[54] COMPETITIVE GAME APPARATUS

[75] Inventors: Jeffrey D. Breslow, Highland Park; Michael J. Ferris; Henry Arias, both of Chicago, all of Ill.

[73] Assignee: Marvin Glass & Associates, Chicago, Ill.

[21] Appl. No.: 91,093

[22] Filed: Nov. 5, 1979

[51] Int. Cl.[3] ..... A63F 7/24

[52] U.S. Cl. ..... 273/119 R; 273/129 W

[58] Field of Search ..... 273/85 A, 85 B, 119 R, 273/119 A, 123 R, 123 A, 124 R, 124 A, 125 R, 125 A, 129

[56] References Cited

U.S. PATENT DOCUMENTS

| | | | |
|---|---|---|---|
| 565,954 | 8/1896 | Austin et al. | 273/119 R |
| 3,119,620 | 1/1964 | Peterson | 273/125 R X |
| 3,466,042 | 9/1969 | Lucci | 273/85 A |
| 3,643,955 | 2/1972 | Breslow | 273/DIG. 26 X |

FOREIGN PATENT DOCUMENTS

| | | | |
|---|---|---|---|
| 1051276 | 9/1953 | France | 273/85 A |
| 893003 | 4/1962 | United Kingdom | 273/85 B |

*Primary Examiner*—Anton O. Oechsle

*Attorney, Agent, or Firm*—Mason, Kolehmainen, Rathburn & Wyss

[57] ABSTRACT

A game includes a playing field that in the preferred embodiment may be concave toward a goal in the form of a central aperture. A playing object such as, in the preferred embodiment, a ball is included with the game and the object of the game is to move the ball into the goal. At least one player actuated paddle member is pivotally mounted on the playing field and may be manually actuated by the hand of a player of the game to engage the playing object in an attempt to direct it into the goal. The playing field is positioned on a base and supported thereabove to allow the hand of the player to grasp a handle depending from the peddle member through and beneath the playing field. The playing field preferably includes a surrounding or peripheral rim on which a scoring device for recording the score of the player is mounted.

4 Claims, 3 Drawing Figures

COMPETITIVE GAME APPARATUS

BACKGROUND OF THE INVENTION

1. Field of the Invention

The present invention relates to a new and improved game apparatus including a playing object and a goal into which the object is to be moved in order to score points.

2. Description of the Prior Art

Of the many types of games enjoyed by children and adults alike are those in which a playing field includes a goal into which a scoring object, such as a ball or disc, is moved in order to score points. This type of game is more enjoyable if played by more than one player so that there is competition in scoring or preventing goals from being scored. Such games, however, are often complex, costly to manufacture and difficult for younger children to play since the eye-hand co-ordination and strength required are greater than that possessed by small children.

In addition, many of the prior art competitive games are designed around well known sports such as baseball, basketball or football that require a basic knowledge of the rules of the games normally only known by older children and thus not playable by younger children who are not familiar with the game or the rules. Also, these prior art games require sophisticated hand movement or actuation of spring devices which children of younger ages are not capable of doing. Furthermore, the typical prior art games include objects for engaging the playing object that appear as players of the sports after which the game is designed such as baseball players or basketball players and these particular objects are not normally entertaining to children of younger ages.

SUMMARY OF THE INVENTION

An object of the present invention is to provide a new and improved game apparatus.

Another object of the present invention is to provide a new and improved game apparatus that can be easily operated and enjoyed by children.

A further object of the present invention is to provide a new and improved game that can be easily understood by young children.

The present invention is directed to a new and improved game including a scoring field having a goal such as an aperture defined therein. Rotatably mounted on the scoring field are a plurality of engagement members such as paddles or the like that may be in the configuration of an animal. The paddles include handles extending through and beneath the playing field so as to be grasped by the player to allow the paddle to be rotated to engage a playing object moving it toward the goal. The playing field is supported above a base to allow the child's hand to be maneuvered beneath the playing field to grasp the handle and actuate the paddle member. A scoring mechanism may be included on the peripheral edge of the playing field to keep score of the game being played.

BRIEF DESCRIPTION OF THE DRAWINGS

The above and other objects and advantages and novel features of the present invention will become apparent from the following detailed description of a preferred embodiment of the invention illustrated in the accompanying drawing wherein.

DESCRIPTION OF THE PREFERRED EMBODIMENT

Figure 1:
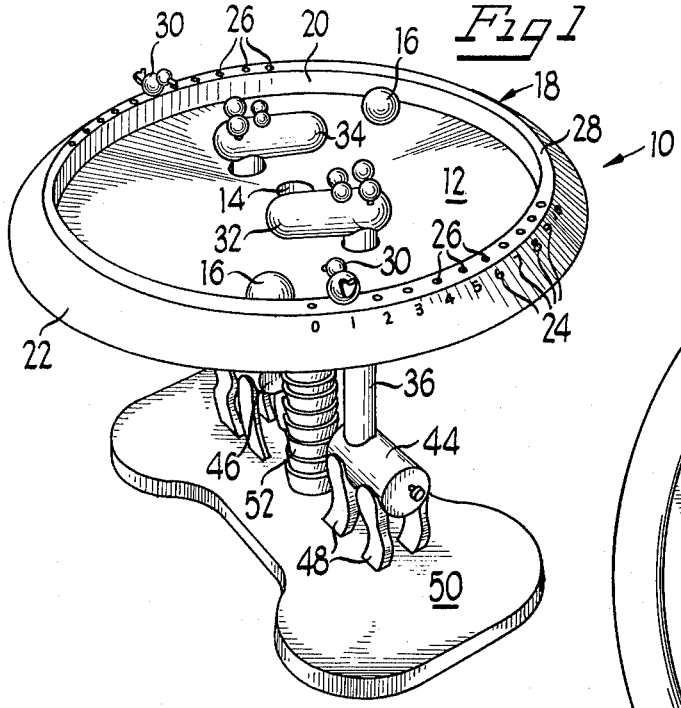
FIG. 1 is a perspective view of a game constructed in accordance with the principles of the present invention.

Having reference now to the drawing and initially to FIG. 1, there is illustrated a game generally designated by the reference numeral 10 that is designed to be employed by children of all ages, but particularly younger children since the rules are easy to understand and the game is easy to operate by a small child's hand. The game 10 includes an elevated playing field 12 that in the preferred embodiment illustrated is circular and concave toward the center thereof at which location is an aperture or goal 14. Scoring may be made more difficult by increasing or decreasing the angular slope of the playing field 12 toward the goal 14. For example, if the playing field 12 were level, it can be understood that it would be more difficult to move a playing object such as the ball 16 into the goal or aperture 14. The difficulty of scoring a goal in this manner would be even more difficult if the playing field 12 were sloped downwardly from the goal 14 toward the outer rim or edge 18 of the playing field 12. Accordingly, although the playing field 12 is illustrated as being concave downwardly toward the goal 14, it is to be understood that the game 10 of the present invention is not limited to this specific configuration. Also, the playing field 12 is illustrated as being circular further simplifying the difficulty of scoring a goal, however, it is to be understood that the configuration of the playing field 12 may be other than circular and can be multi-sided adding an additional feature to the game wherein the playing objects or ball 16 may be ricocheted off of the sides to score goals, thus adding an additional characteristic to the game similar to billiards.

The rim 18 of the playing field 12 includes a first vertical wall portion 20 approximately the height of the playing object or ball 16 thereby containing the playing object 16 on the playing field 12. In addition, the rim 18 includes an outer peripheral sloping flange 22 that is angled so that indicia 24 may be imprinted thereon. A plurality of apertures 26 are provided in a top horizontal lip portion 28 of the rim 18. The sloping flange 22, the indicia 24 and the apertures 26 define a scoring means for the game 10.

More specifically, the sloped surface 22 is at an angle so that indicia 24 is easily observable by the player of the game 10. Pegs 30 in that preferred embodiment are in the configuration of birds and are positioned in the aperture 26 adjacent to the proper indicia 24 indicating the score of each player. The score boards are on the rim 18 adjacent the corresponding player.

The game apparatus 10 includes a pair of paddles 32 and 34 for striking the ball 16. The paddles 32 and 34, in the preferred embodiment, are in the configuration of an animal's head, such as a giraffe. The animal's head is mounted on handles 36 and 38, respectively, that are in the configuration of necks depending from the head. The handles 36 and 38 extend a sufficient distance to define an adequate surface to be grasped by the hand of the child playing the game 10. The handles 36 and 38 are rotatably mounted within apertures 40 and 42, respectively, defined in the playing surface 12. The lower ends of the handles 36 and 38 are pivotally mounted in appropriate animal torsos 44 and 46, in this instance, the torsos are in the configuration of giraffes' bodies that are mounted on supports or legs 48.

The legs 48 are mounted on a supporting base member 50. The playing field 12 is also mounted on the base 50 by a vertical support 52 secured to the bottom surface of the playing field 12 between the torsos 44 and 46. The base 50 and the support 52 may be in numerous configurations to conform to the theme of the game 10. In the preferred embodiment illustrated, the support 52 is in the configuration of a palm tree to correspond to the African theme of the game 10.

Figure 2:
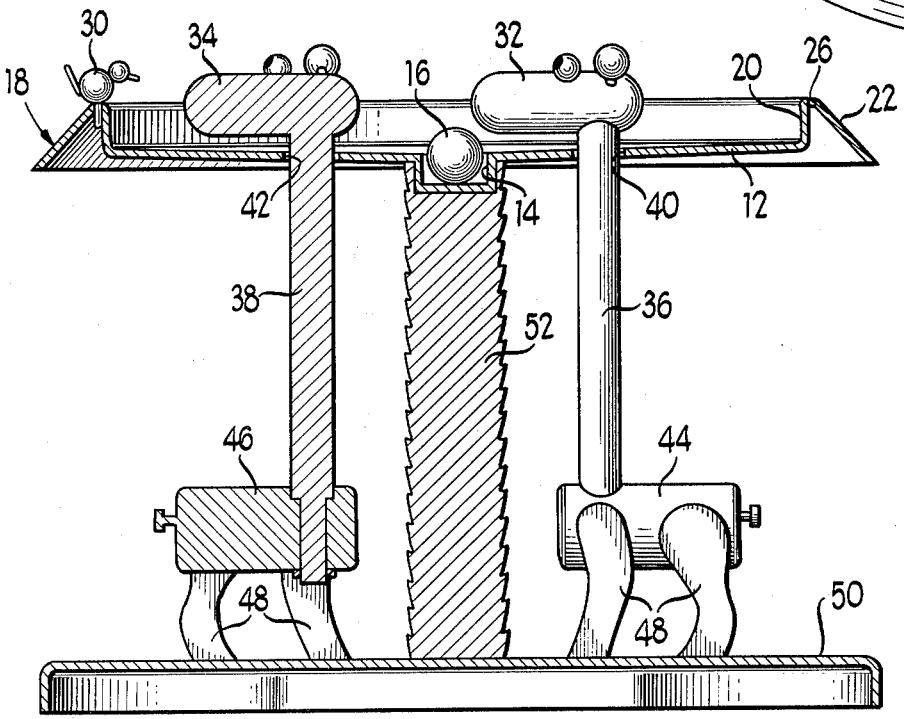
FIG. 2 is an enlarged vertical cross-sectional view of FIG. 1.

As can be understood, the object of the game 10 is for the players to manually grasp the necks 36 and 38 and to pivot them within the apertures 40 and 42 and the torso portions 44 and 46 so that the paddle members or heads 32 and 34 engage the ball or playing object 16 in an attempt to direct the ball 16 into the aperture 14. As can be best seen in FIG. 2, the aperture 14 is circular and of a depth less than the diameter of the playing object 16 so that a sufficient amount of the ball 16 is above the field 12 after a goal is scored to allow a child to grasp the ball 16 and remove it from the aperture 14. In addition, although the rim of the aperture 14 is shown as being square, the rim may also be beveled to allow easy scoring and removal of the ball 16 from the aperture 14.

Figure 3:
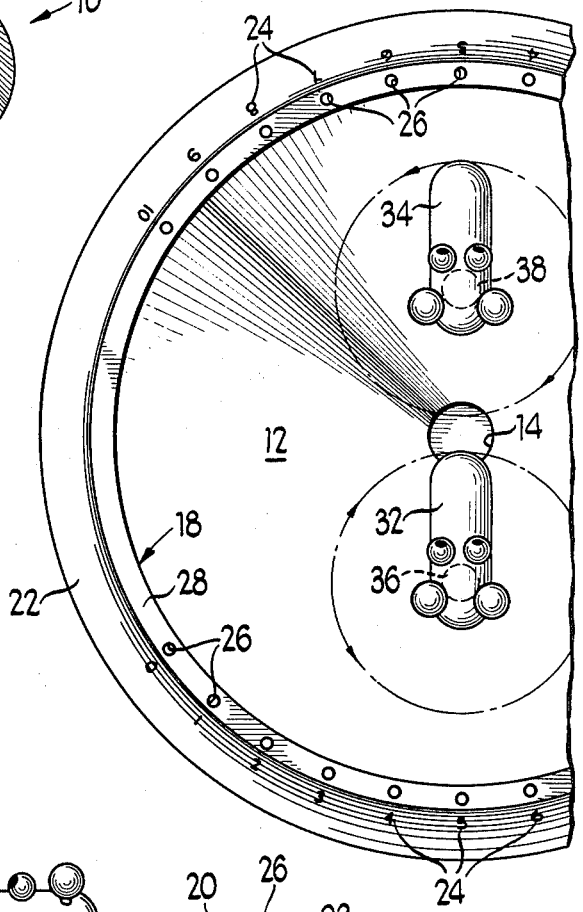
FIG. 3 is a partially fragmented plan view of the game of the present invention.

With reference to FIG. 3, it is seen that the heads or paddles 32 or 34 are of a sufficient dimension to extend over only a portion of the aperture 14 to be a substantial distance from the wall and spaced apart to prevent engagement. The length of the paddles or head members 32 and 34 may be varied so as to affect the complexity of the game 10. For example, longer paddles 32 and 34 reduce the difficulty in engaging the ball and moving it toward the aperture 14 whereas smaller or shorter paddles 32 and 34 increase the difficulty of engaging the ball 16 and moving it into scoring position.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A competitive game apparatus wherein scores are made by moving an object, such as ball or the like, into a goal, comprising:

a base for supporting the apparatus on a suitable support surface;

a concave playing surface with said goal located at the approximate center of said field;

support means on the base for mounting the playing surface at an elevated position;

a pair of paddles rotatably mounted on the playing surface for striking the object;

a handle for each of said paddles extending below the surface for manual grasping by the players of the game to effect rotation of the paddles and handle support means mounted on the base for rotatably mounting the lowermost end of each of said handles, wherein said handle support means are in the form of an animal torso.

2. The game apparatus as set forth in claim 1 wherein said handles are in the form and shape of the neck of an animal.

3. The game apparatus of claim 2 wherein the paddles are in the form and shape of an animal head.

4. The game apparatus of claims 2 or 3 wherein said animal is a giraffe.

* * * * *